US008919556B2

(12) United States Patent
Kimoto et al.

(10) Patent No.: US 8,919,556 B2
(45) Date of Patent: Dec. 30, 2014

(54) CONTAINER AND PALLET-INCORPORATED CONTAINER ASSEMBLY

(71) Applicant: FUJIFILM Corporation, Tokyo (JP)

(72) Inventors: Nobuyuki Kimoto, Minami-Ashigara (JP); Fumihito Imai, Minami-Ashigara (JP); Takuya Nakazawa, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/036,241

(22) Filed: Sep. 25, 2013

(65) Prior Publication Data

US 2014/0090998 A1 Apr. 3, 2014

(30) Foreign Application Priority Data

Sep. 28, 2012 (JP) ..... 2012-217535

(51) Int. Cl.

| | |
|---|---|
| ***B65D 85/66*** | (2006.01) |
| ***B65D 19/02*** | (2006.01) |
| ***B65D 77/00*** | (2006.01) |
| ***B65D 19/06*** | (2006.01) |
| ***B65D 5/50*** | (2006.01) |
| ***B65D 85/672*** | (2006.01) |

(52) U.S. Cl.

CPC ..... *B65D 19/02* (2013.01); *B65D 77/00* (2013.01); *B65D 19/06* (2013.01); *B65D 5/50* (2013.01); *B65D 5/5035* (2013.01); *B65D 85/672* (2013.01); *B65D 2519/00019* (2013.01); *B65D 2519/00159* (2013.01); *B65D 2519/00228* (2013.01); *B65D 2519/00273* (2013.01); *B65D 2519/00288* (2013.01); *B65D 2519/00323* (2013.01); *B65D 2519/00333* (2013.01); *B65D 2519/00497* (2013.01); *B65D 2519/00621* (2013.01); *B65D 2519/00661* (2013.01); *B65D 2519/00815* (2013.01); *B65D 2571/00018* (2013.01)

USPC ..... 206/391; 206/386; 206/408; 206/416; 206/485

(58) Field of Classification Search

USPC ..... 206/386, 391, 397, 407, 408, 413, 415, 206/416, 443, 446, 485, 600, 392

See application file for complete search history.

(56) References Cited

U.S. PATENT DOCUMENTS

| | | | | |
|---|---|---|---|---|
| 3,332,546 | A * | 7/1967 | De George | 206/395 |
| 3,530,980 | A * | 9/1970 | Link | 206/394 |

(Continued)

FOREIGN PATENT DOCUMENTS

| | | | |
|---|---|---|---|
| GB | 1192772 | | 5/1970 |
| JP | 62-174034 | U | 11/1987 |
| JP | 2002-080087 | A | 3/2002 |
| JP | 4108202 | B2 | 6/2006 |
| JP | 2008-230669 | A | 10/2008 |
| JP | 4519298 | B2 | 8/2010 |
| JP | 2011-507774 | A | 3/2011 |
| WO | 9843883 | A1 | 10/1998 |

OTHER PUBLICATIONS

Office Action, Issued by the Japanese Patent Office, Dated Sep. 2, 2014, In counterpart Japanese Application No. 2012-217535.

*Primary Examiner* — Luan K Bui

(74) *Attorney, Agent, or Firm* — Sughrue Mion, PLLC

(57) ABSTRACT

A container for housing a roll-shaped member having a core, includes: a tray as defined herein; a pair of first side plates as defined herein; and a cap as defined herein, and each of the pair of side walls is formed with a first slit as defined herein; each of the pair of first side plates is formed with a second slit as defined herein; and a height H1 of a slit bottom portion of the first slit of each of the side walls and a height H2 of a slit bottom portion of the second slit of each of the first side plates as measured from the bottom wall of the tray with the pair of first side plates disposed on the bottom wall parallel with the respective side walls satisfy a relationship H2>H1.

14 Claims, 14 Drawing Sheets

(56) References Cited

U.S. PATENT DOCUMENTS

| | | | | | |
|---|---|---|---|---|---|
| 4,027,794 | A * | 6/1977 | Olson | ..... | 206/395 |
| 4,151,914 | A * | 5/1979 | Blatt | ..... | 206/386 |
| 4,217,984 | A * | 8/1980 | Magnuson | ..... | 206/403 |
| 5,704,479 | A * | 1/1998 | Barnett et al. | ..... | 206/395 |
| 6,003,667 | A * | 12/1999 | Barnett et al. | ..... | 206/396 |
| 6,805,240 | B2 * | 10/2004 | Smarr et al. | ..... | 206/416 |
| 8,336,711 | B2 * | 12/2012 | Katsurayama et al. | ..... | 206/397 |
| 8,590,772 | B2 | 11/2013 | Delause et al. | | |
| 2011/0000957 | A1 | 1/2011 | Delause et al. | | |

* cited by examiner

CONTAINER AND PALLET-INCORPORATED CONTAINER ASSEMBLY

CROSS-REFERENCE TO RELATED APPLICATIONS

This application claims the benefit of Japanese Patent Application JP 2012-217535, filed Sep. 28, 2012, the entire content of which is hereby incorporated by reference, the same as if set forth at length.

FIELD OF THE INVENTION

The present invention relates to a container and a pallet-incorporated container assembly.

BACKGROUND OF THE INVENTION

Among containers for transport of roll-shaped members of magnetic recording tape and film etc. are ones disclosed in Japanese Patent No. 4,108,202 and Japanese Patent No. 4,519,298. The container disclosed in Japanese Patent No. 4,108,202 is made of returnable packing materials; a housing space is defined by assembling panels which are made of strong reinforced plywood. Such a container is transported to a destination in a state that roll-shaped members of magnetic recording tape or the like are housed in the thus-formed housing space. Used containers are collected at the destination and reused as transport containers.

More specifically, as shown in FIG. 14, in this type of container, panels in storage are assembled together into a container and products are packed into the thus-assembled container and shipped. At a transport destination, the container is unpacked and the products are unloaded, that is, separated from the container. Containers are decomposed into small parts and returned to the transport source in the form of piles of small folded parts. At the transport source, the returned containers are cleaned and stored for next use.

The container disclosed in Japanese Patent No. 4,519,298 is composed of corrugated paper instead of reinforced plywood. This increases the container manufacturing cost and enables repeated use while facilitating transport and storage by virtue of weight reduction.

SUMMARY OF THE INVENTION

However, in the case of returnable containers as disclosed in Japanese Patent No. 4,108,202 and Japanese Patent No. 4,519,298, it is necessary to disassemble used containers and return them to a transport source, which is disadvantageous in that cumbersome work is necessary and the returning causes an extra cost. Furthermore, in the case of the container disclosed in Japanese Patent No. 4,108,202, since returned containers are cleaned, its reusability may increase the cost even if a cost reduction by the reuse of containers is taken into account.

The container disclosed in Japanese Patent No. 4,519,298 requires a reinforcement member when containers are piled up during storage or transport. Since the reinforcement member is shaped like a frame so as to surround products, it increases the size and weight of a container, resulting in increase in transport cost and packing material cost.

An object of the present invention is therefore to provide a container and a pallet-incorporated container assembly which can be reduced in size and weight while maintaining necessary strength and which can reduce the transport cost though they are disposable.

The invention provides the following:

(1) A container for housing a roll-shaped member having a core, comprising;

a tray having a bottom wall and a pair of side walls which are erected from the bottom wall so as to be opposed to each other and to extend perpendicularly to an axis of the core when the roll-shaped member is housed in the container;

a pair of first side plates disposed on the bottom wall parallel with the respective side walls; and a cap which has a top wall opposed to the bottom wall of the tray and is disposed so that the roll-shaped member can be interposed between the cap and the tray, wherein:

each of the pair of side walls is formed with a first slit which extends from a top sideline of the side wall to a halfway position in a direction toward a bottom sideline of the side wall, and in which the core of the roll-shaped member can be inserted;

each of the pair of first side plates is formed with a second slit which extends from a top sideline of the first side plate to a halfway position in a direction toward a bottom sideline of the first side plate, which is located at such a position as to face the associated first slit with the first side plate disposed on the bottom wall of the tray parallel with the associated side wall, and which is to support the core; and a height H1 of a slit bottom portion of the first slit of each of the side walls and a height H2 of a slit bottom portion of the second slit of each of the first side plates as measured from the bottom wall of the tray with the pair of first side plates disposed on the bottom wall parallel with the respective side walls satisfy a relationship H2>H1.

(2) A pallet-incorporated container assembly comprising:

the container according to any one of items (1) to (9); and a pallet which is mounted with the container on a top surface.

The container and the pallet-incorporated container assembly can be reduced in size and weight while maintaining necessary strength, and can reduce the transport cost though they are disposable.

DESCRIPTION OF SYMBOLS

Figure 1:
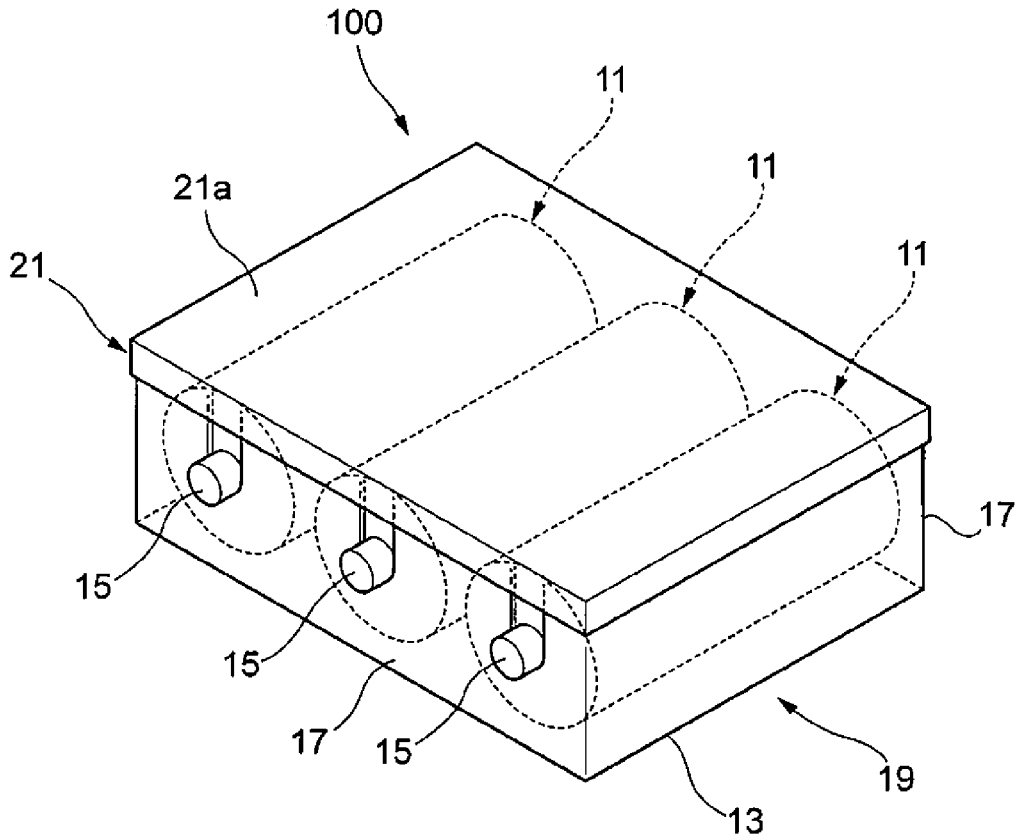
FIG. 1 is a perspective view of a container according to an embodiment of the present invention which houses roll-shaped members in each of which a band-shaped material is wound on a winding core.

11: Roll-shaped member
13: Bottom wall
15: Winding core (core)
17: Side wall
19: Tray
21: Cap
27: Pallet
29: First side plate
31: Second side plate
33: Deviation preventive projection (first engagement portion)
35: Engagement hole (first engagement portion)
41: Winding core stop slit (first slit)
41*a*: Bottom portion
43: Side wall top sideline
45: Side wall bottom sideline
47: Winding core support slit (second slit)
47*a*: Bottom portion
49: First side plate top sideline
51: First side plate bottom sideline
53: Winding core pressing slit (third slit)
53*a*: Top portion
55: Second side plate bottom sideline
57: Second side plate top sideline
61: Seat
63: Seat
67: Packing band
69: Stretch film
100: Container
100A, 100B: Container
200: Pallet-incorporated container assembly
300: Cargo container

DETAILED DESCRIPTION OF THE INVENTION

Figure 2:
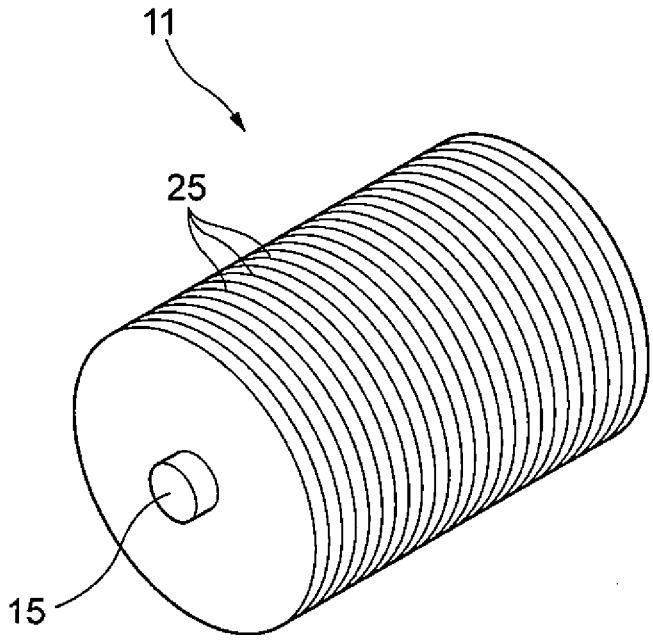
FIG. 2 is a perspective view of one of the roll-shaped members shown in FIG. 1.

An embodiment of the present invention will be hereinafter described in detail with reference to the drawings. FIG. 1 is a perspective view of a container according to the embodiment which houses roll-shaped members in each of which a band-shaped material is wound on a winding core. FIG. 2 is a perspective view of one of the roll-shaped members shown in FIG. 1.

As shown in FIG. 1, the container 100 houses three roll-shaped members 11 which are arranged parallel with each other. The container 100 is equipped with a cap 21 and a tray 19 having a bottom wall 13 and a pair of side walls 17 which are erected from the bottom wall 13. The pair of side walls 17 are disposed perpendicularly to the axes of the winding cores 15 of the roll-shaped members housed in the tray 19 so as to be opposed to each other.

The container 100 is also equipped with a pair of first side plates 29 and a pair of second side plates 31 (described later in detail) which are disposed on and above the bottom wall 13 parallel with the side walls 17. Each of the tray 19, the cap 21, the first side plates 29, and the second side plates 31 is made of a corrugated paper material which is a multilayer structure having plural liner layers and core layers. Corrugated paper materials are suitable for containers because they are less expensive than plastic materials and metal materials, are light and strong, have high impact absorbency because of its structure, provide such convenience that they can be folded and assembled, and other advantages. Corrugated paper materials are superior in terms of cost and environmental loads because they can be recycled as used paper. The strength can be increased by employing the multilayer structure having plural liner layers and core layers.

As shown in FIG. 2, each roll-shaped member 11 included in the embodiment is a layered body in which the winding core 15 (core) is inserted in and concentrically supports many pancake tapes 25 in each of which a cut-out magnetic recording tape having a prescribed constant width is wound on a hub. The winding core 15 is a circular pipe made of vinyl chloride or the like, and its two outside end portions in the axial direction that project sideways from the respective end planes of the array of pancake tapes 25 are supported by the container 100.

Figure 3:
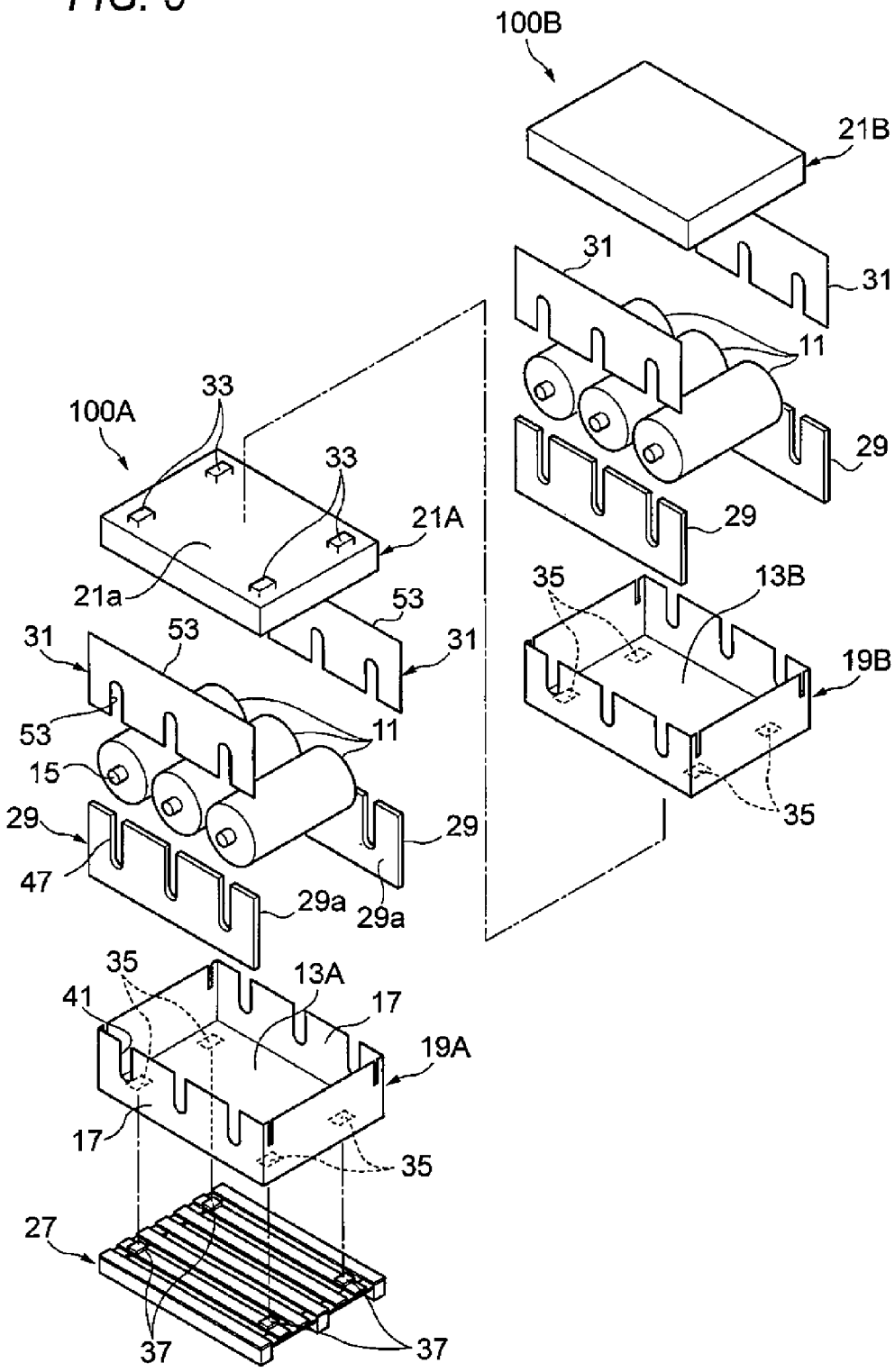
FIG. 3 is an exploded perspective view of a lower container and an upper container which are two containers of FIG. 1 piled up on a pallet.

FIG. 3 is an exploded perspective view of a lower container 100A and an upper container 100B which are two containers 100 piled up on a pallet. The following description, the same members will be given the same reference symbols and descriptions therefor may be simplified or omitted.

The container 100A which is mounted directly on the pallet 27 is equipped with a tray 19A having a bottom wall 13A and a pair of side walls 17 erected from the bottom wall 13A and a pair of first side plates 29 which are disposed on the bottom wall 13A parallel with the respective side walls 17 and support winding cores 15. The container 100A is also equipped with a pair of second side plates 31 which are disposed parallel with the respective first side plates 29 and the respective side walls 17. The container 100A is also equipped with a cap 21A having a top wall 21*a* which is opposed to the bottom wall 13A. The cap 21A is disposed so that the roll-shaped members 11 are interposed between itself and the tray 19.

The container 100B is mounted on the container 100A. The top wall 12*a* of the cap 21A of the container 100A is formed with four deviation preventive projections 33 (first engagement portions) near the respective corners. A bottom walls 13B of a tray 19B of the container 100B is formed with four engagement holes 35 (first engagement portions) near the corners at positions corresponding to the positions of the respective deviation preventive projections 33.

The deviation preventive projections 33 (male portions) of the cap 21A are inserted into the respective engagement holes 35 (female portions) of the tray 19B, whereby, when piled up, the containers 100A and 100B are prevented from deviating laterally from each other and suffering a load shift. Like the tray 19B, the tray 19A is formed with engagement holes 35.

The top surface of the pallet 27 is formed with four deviation preventive projections 37 (second engagement portions) near the respective corners at positions corresponding to the positions of the respective engagement holes 35 (second engagement portions) of the tray 19A. The deviation preventive projections 37 (male portions) of the pallet 27 are engaged with the respective engagement holes 35 (female portions) of the tray 19A, whereby, when mounted on the pallet 27, the container 100A is prevented from deviating laterally and suffering a load shift. The deviation preventive projections 37 of the pallet 27 have the same shape as deviation preventive projections 33 of the cap 21A, and hence can engage with the engagement holes 35 of each of the trays 19A and 19B.

Figure 4:
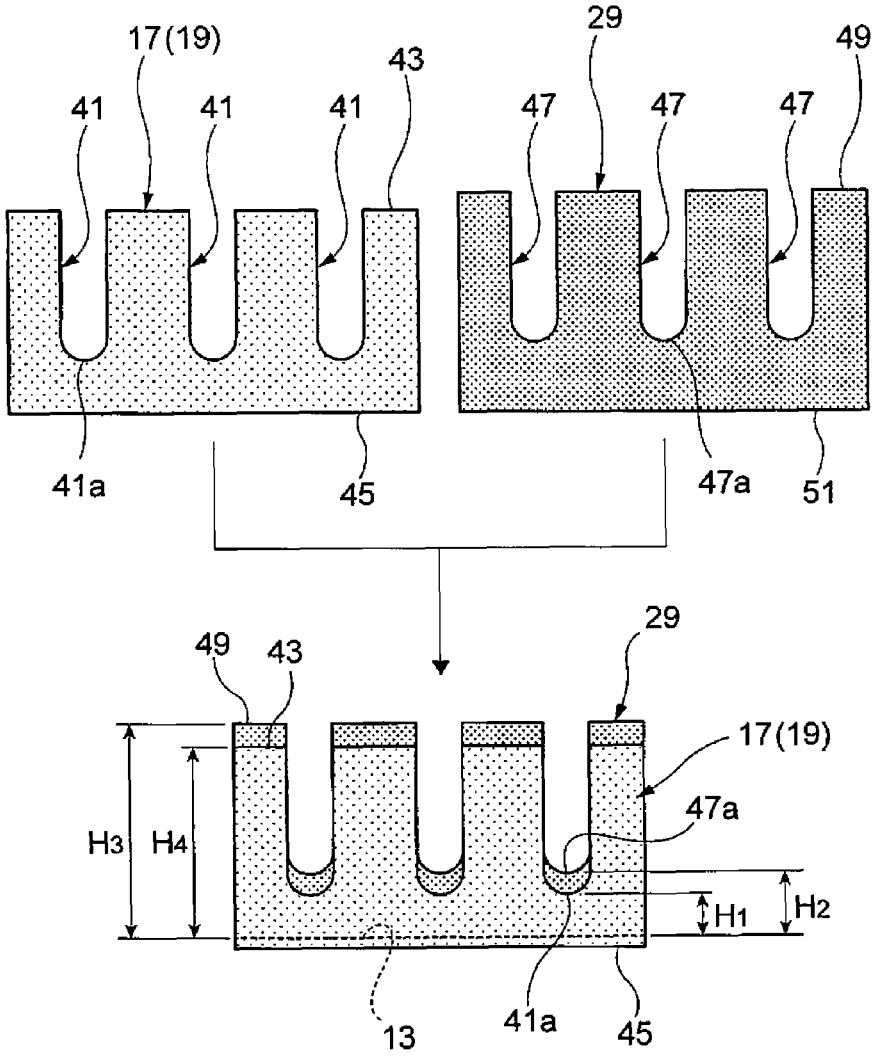
FIG. 4 shows a side wall of a tray and a first side plate (viewed from the side) and illustrates how they are arranged parallel with each other.

Next, a detailed description will be made of a support structure for supporting the roll-shaped members 11 of the above-described container 100 (100A, 100B). FIG. 4 shows a side wall 17 of the tray 19 and a first side plate 29 (viewed from the side) and illustrates how they are arranged parallel with each other.

As also shown in FIG. 3, each side wall 17 of the tray 19 is formed with winding core stop slits 41 (first slits) for stopping the winding cores 15 of the roll-shaped members 11, respectively, when they are inserted. In the container 100 according to the embodiment, to house the three roll-shaped members 11, three winding core stop slits 41 are formed at the same intervals. Each winding core stop slit 41 is a U-shaped slit (cut) extending in the vertical direction from a top sideline 43 toward a bottom sideline 45 (ends halfway). The U-shaped slit can disperse a load acting on the slit.

Each first side plate 29 is formed with winding core support slits 47 (second slits) for stopping the respective winding cores 15 of the roll-shaped members 11 at the same positions as the winding core stop slits 41 are formed in each side wall 17. Each winding core support slit 47 is a U-shaped slit (cut) extending in the vertical direction from a top sideline 49 toward a bottom sideline 51 (ends halfway). Each first side plate 29 is formed so that, when disposed on the bottom wall 13 of the tray 19 parallel with the associated side wall 17, the height H2 of slit bottom portions 47*a* of the winding core support slits 47 as measured from the bottom wall 13 is greater than the height H1 of slit bottom portions 41*a* of the winding core stop slits 41 as measured from the bottom wall 13, that is, a relationship H2>H1 is satisfied.

The height H3 of each first side plate 29 as measured from the bottom wall 13 is greater than the height H4 of each side wall 17 as measured from the bottom wall 13, that is, a relationship H3>H4 is satisfied (the top sideline 49 is located above the top sideline 43).

Figure 5:
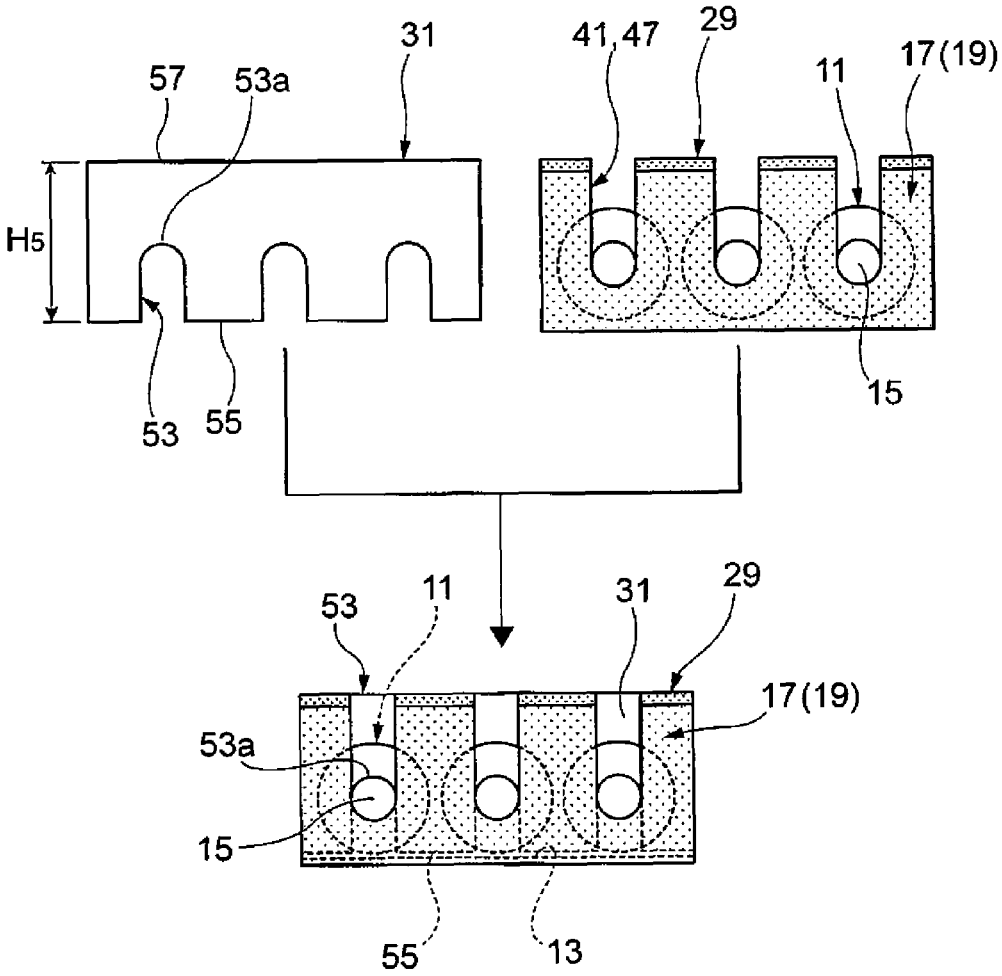
FIG. 5 shows a side wall of the tray, a first side plate, and a second side plate (viewed from the side) and illustrates how they are arranged parallel with each other.

FIG. 5 shows a side wall 17 of the tray 19, a first side plate 29, and a second side plate 31 (viewed from the side) and illustrates how they are arranged parallel with each other.

As shown in FIGS. 3 and 5, the pair of second side plates 31 are disposed parallel with the side walls 17 of the tray 19 and the first side plates 29, respectively, adjacent to confronting inner side surfaces 29*a* (see FIG. 3) of the first side plates 29, respectively.

As shown in FIG. 5, each second side plate 31 is formed, at the same positions as the positions of the winding core stop slits 41 of the side wall 17 and the winding core support slits 47 of the first side plate 29, with winding core pressing slits 53 (third slits) which transmit vertical loads transmitted from the cap 21 to the inserted winding cores 15 of the roll-shaped members 11 by means of their slit top portions 53*a*, respectively. Each winding core pressing slit 53 of each second side plate 31 is a U-shaped slit (cut) extending in the vertical direction from a bottom sideline 55 toward a top sideline 57 (ends halfway).

The top sideline 57 of each second side plate 31 is in contact with the inner surface of the cap 21 and the slit top portions 53*a* of the winding core pressing slits 53 are in contact with the winding cores 15 of the roll-shaped members 11, respectively. The height H5 of each second side plate 31 is smaller than the height H3 of each first side plate 29 (see FIG. 4). Therefore, as shown in FIG. 5, in a state that the slit top portions 53*a* of each second side plate 31 are in contact the respective winding cores 15, a gap is formed between the bottom sideline 55 of the second side plate 31 and the bottom wall 13 of the tray 19.

Next, a description will be made of how the above-configured container 100 works.

Figure 6A:
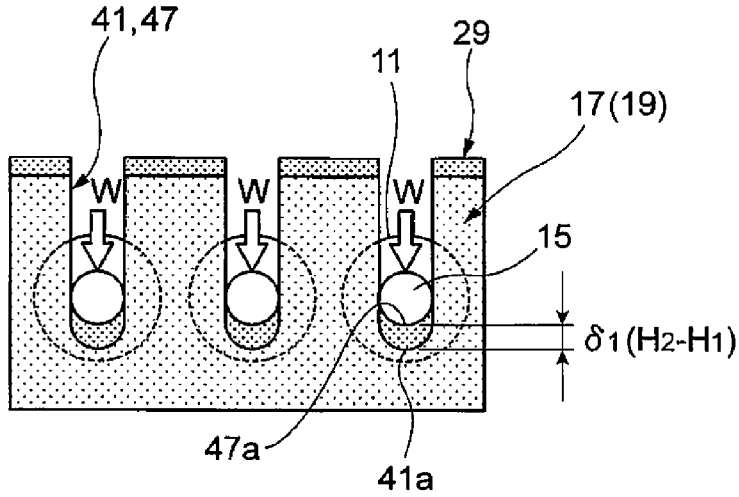
FIG. 6A is a side view showing a state that each first side plate is incorporated in the tray and supports the roll-shaped members.

FIG. 6A is a side view showing a state that each first side plate 29 is incorporated in the tray 19 and supports the roll-shaped members 11. In this state, the winding cores 15 of the roll-shaped members 11 are supported by the slit bottom portions 47*a* of the winding core support slits 47 of each first side plate 29. A load which is the sum of the weights of the roll-shaped members 11 themselves, external force due to vertical vibration, the weight of containers mounted above, etc. acts on the slit bottom portions 47*a* via the winding cores 15, respectively.

Figure 6B:
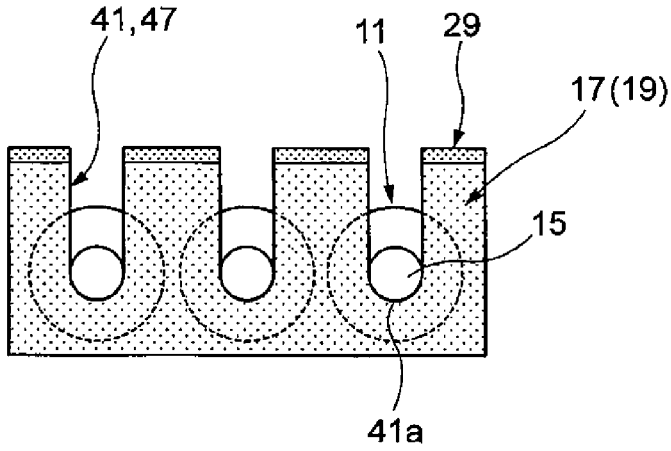
FIG. 6B is a side view showing a state that the slit bottom portions of the winding core support slits are crushed to the positions of the slit bottom portions of the winding core stop slits of the side wall of the tray.

When a load W is exerted on a slit bottom portion 47*a* which is the bottom portion of a U-shaped slit, the slit bottom portion 47*a* is bent elastically and supports the winding core 15 elastically. If the load W is beyond the elastic deformation range of the slit bottom portion 47*a* and in its plastic deformation range, as shown in FIG. 6B the slit bottom portion 47*a* is crushed (i.e., the first side plate 29 is crushed there locally) to the position of the slit bottom portion 41*a* of the winding core stop slit 41 of the side wall 17.

Figure 7B:
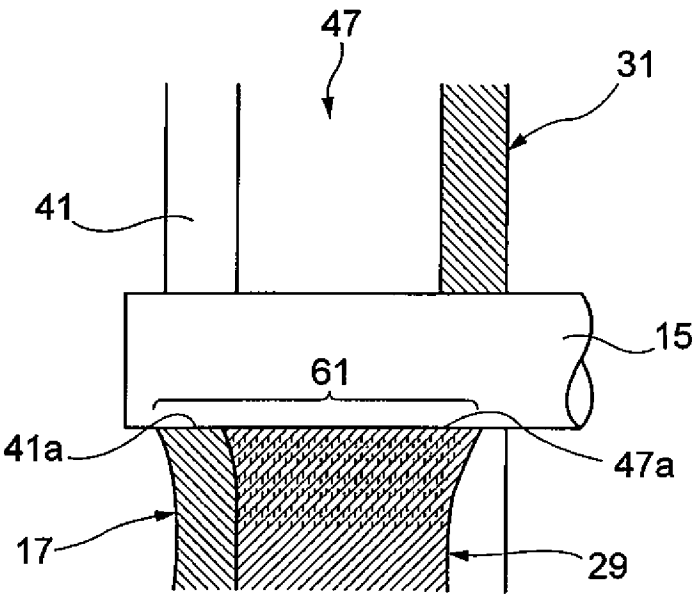
FIGS. 7A and 7B are schematic sectional views illustrating how a slit bottom portion of each first side plate is crushed.
Figure 7A:
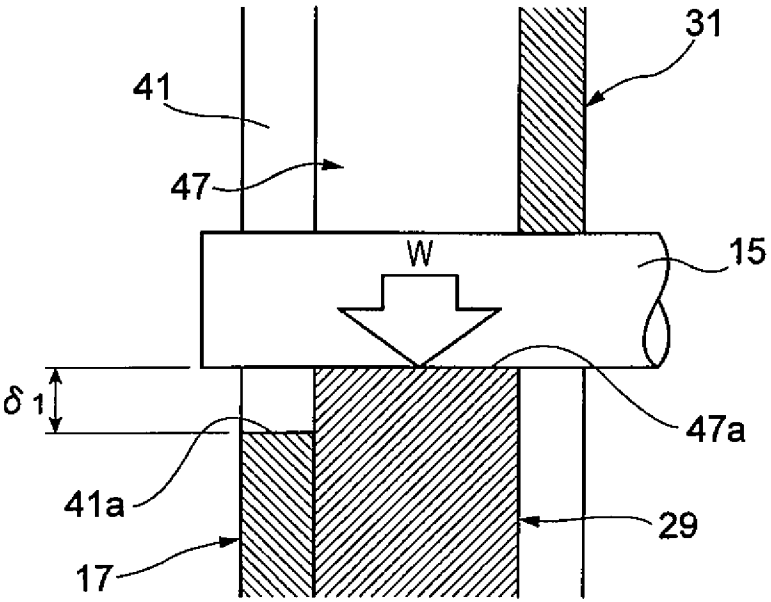

FIGS. 7A and 7B are schematic sectional views illustrating how the slit bottom portion 47*a* of each first side plate 29 is crushed. As shown in FIG. 7A, when a load is exerted on a winding core 15, the load is born by the slit bottom portions 47*a* of the pair of first side plates 29 which are disposed at the two respective ends of the winding core 15. If the load W acting on a slit bottom portion 47*a* is beyond the elastic deformation range of the first side plate 29 and in its plastic deformation range, as shown in FIG. 7B the slit bottom portion 47*a* is plastically deformed downward and crushed to the position (in the height direction) of the slit bottom portion 41*a* of the side wall 17. That is, each first side plate 29 has a first deformation region (having a length δ1 in the height direction) that can be deformed plastically when receiving a load from the winding core 15 between the slit bottom portion 47*a* of each winding core support slit 47 and the slit bottom portion 41*a* of the associated winding core stop slit 41. Each first side plate 29 is deformed locally in the first deformation regions.

At this time, the portion, in contact with the winding core 15, of the slit bottom portion 47*a* of the first side plate 29 is expanded by the plastic deformation, whereby its area of contact to the winding core 15 is increased. This contact portion is increased in compression resistance because the material density is increased there through compression. Furthermore, the slit bottom portion 41*a* of the associated side wall 17 is adjacent to the contact portion of the first side plate 29. As a result, a wide seat 61 (41*a*, 47*a*) for supporting the winding core 15 is formed. Thus, a high-strength support structure capable of supporting the winding cores 15 stably is produced.

Figure 8:
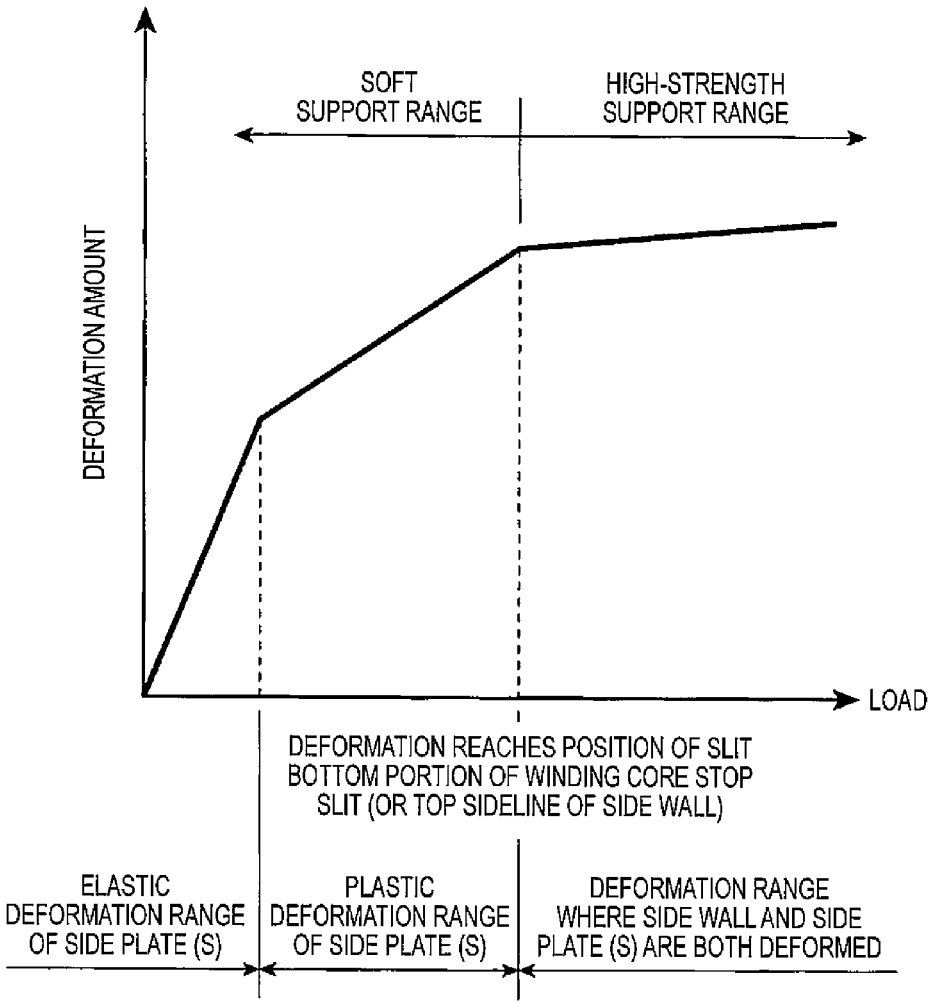
FIG. 8 is a graph roughly showing a relationship between the load received from a winding core and the deformation amount of a first side plate alone or a combination of the first side plate and the associated side wall.

FIG. 8 is a graph roughly showing a relationship between the load W received from a winding core 15 and the deformation amount of a first side plate 29 alone or a combination of the first side plate 29 and the associated side wall 17.

Where the load W that the slit bottom portion 47*a* of the first side plate 29 receives from the associated winding core 15 is in the elastic deformation range of the first side plate 29, the slit bottom portion 47*a* supports the winding core 15 by the elasticity of the material itself of the first side plate 29.

Where the load W is beyond the elastic deformation range of the first side plate 29, the slit bottom portion 47*a* is deformed plastically (i.e., the first side plate 29 is deformed locally). The plastic deformation continues until the winding core 15 reaches the slit bottom portion 41*a* of the associated winding core stop slit 41.

After the winding core 15 has reached the slit bottom portion 41*a*, as described above a high-strength support structure comes to support the winding core 15. Therefore, the increase of the deformation amount with respect to that of the load W is small and the winding core 15 can be supported stably even if the load W is heavy. In this manner, with the above-described structure, each roll-shaped member 11 is supported in two modes generally.

More specifically, the above-described support mechanism consists of a soft support range which is effective until the winding core 15 reaches the slit bottom portion 41*a* of the winding core stop slit 41 and a high-strength support range which comes effective thereafter. In the soft support range, vibration occurring in the associated roll-shaped member 11 or a load of the weight of the associated roll-shaped member 11 itself can be absorbed efficiently utilizing cushioning of the slit bottom portion 47*a*. In the high-strength support range, even a heavy load received from the winding core 15 of the associated roll-shaped members 11 can be supported stably with a small deformation amount. As a result, there does not occur an event that the outer circumferential surfaces of the pancake tapes 25 (see FIG. 2) of the associated roll-shaped member 11 come into contact with an inner surface of the container 100.

The projection length δ1 (H2−H1) of the first side plate 29, that is, the length from the slit bottom portion 47*a* of the winding core support slit 47 of the first side plate 29 to the slit bottom portion 41*a* of the winding core stop slit 41 of the side wall 17, is set taking into consideration a load W, acceleration will be received during transport, the materials and thicknesses of the side wall 17 and the first side plate 29, and other factors. In general, it is preferable that the projection length δ1 be in a range of 1% to 10% of the height H2. If the projection length δ1 is shorter than 1% of the height H2, the winding core 15 reaches the slit bottom portion 41*a* of the winding core stop slit 41 of the side wall 17 and the side wall 17 starts to bear a load in a low-load range. Therefore, the side wall 17 starts to be deformed in a low-load range. This increases the probability that the deformation amount of the side wall 17 goes beyond its elastic deformation range into its plastic deformation range when a heavy load is received from the winding core 15 of the roll-shaped members 11. Plastic deformation of a side wall 17 is not preferable because it requires that an inspection as to whether the roll-shaped members 11 have been damaged or not be made after transport. On the other hand, the projection length δ1 being greater than 10% of the height H2 is not preferable because the container 100 becomes unduly large and heavy, leading to increase in transport cost and material cost. Typical dimensions are as follows: H1=195 mm, H2=200 mm, and δ1=5 mm (2.5% of H2).

Next, a description will be made of how a lower container works when it receives a load from the container immediately above it in the case where plural containers 100 are piled up.

Figure 9A:
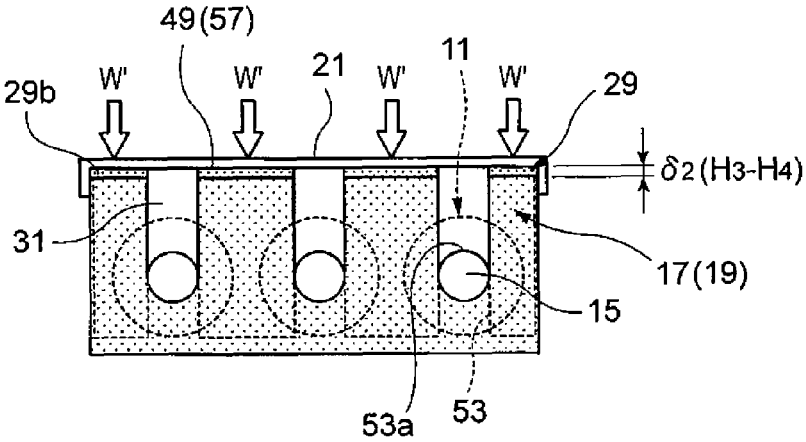
FIGS. 9A and 9B are side views showing a lower container in which the first side plates and the second side plates are incorporated in the tray and the roll-shaped members are supported.
Figure 9B:
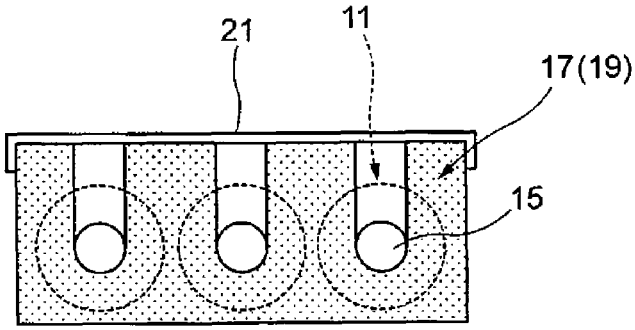
Figure 10A:
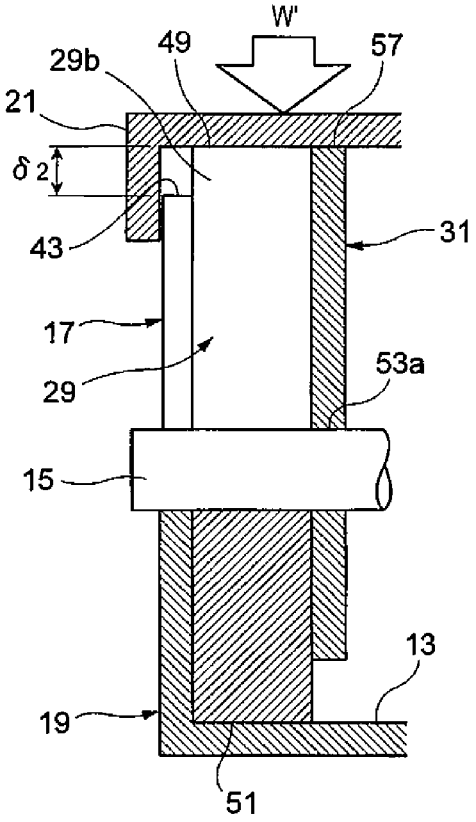
FIGS. 10A and 10B are sectional views corresponding to FIGS. 9A and 9B, respectively.
Figure 10B:
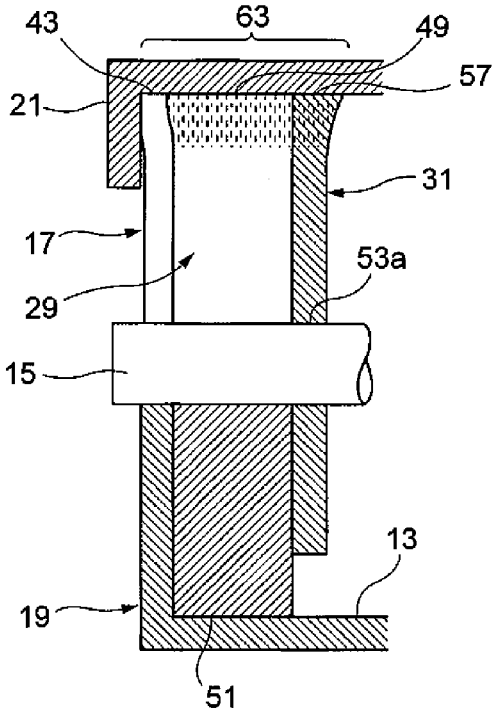

FIGS. 9A and 9B are side views showing a lower container 100 in which the first side plates 29 and the second side plates 31 are incorporated in the tray 19 and the roll-shaped members 11 are supported. FIGS. 10A and 10B are sectional views corresponding to FIGS. 9A and 9B, respectively.

In this case, as shown in FIGS. 9A and 9B, a load W' applied from the container 100 located immediately above of a pile of containers 100 to the pair of first side plates 29 (top sidelines 49) and the pair of second side plates 31 (top sidelines 57) via the cap 21. As shown in FIG. 9A, each first side plate 29 is comb-shaped because of the winding core support slits 47 and has plural (in the example of FIG. 9A, four) projected portions 29*b* which project upward from the level of the top sideline 43 of the associated side wall 17 by δ2.

As shown in FIG. 10A, the top sidelines 49 and 57 are in contact with the inner surface of the cap 21 and bear the load W'. The slit top portions 53*a* of the winding core pressing slits 53 of the second side plates 31 are in contact with the winding cores 15, and the bottom sidelines 51 of the first side plates 29 are in contact with the bottom wall 13 of the tray 19. The load W' is transmitted to the winding cores 15 and the bottom wall 13 while being distributed in the above-described manner.

If the load W' exerted on the cap 21 is such that the elastic deformation ranges of the first side plates 29 and the second side plates 31 are not exceeded, the first side plates 29 and the second side plates 31 are bent elastically to bear the load W'. If the load W' exerted on the cap 21 is such that the elastic deformation ranges of the first side plates 29 and the second side plates 31 are exceeded and their plastic deformation ranges come effective, the first side plates 29 and the second side plates 31 receiving compressive forces are plastically deformed locally. Since each first side plate 29 which is in contact with the bottom wall 13 of the tray 19 is shaped like a comb whose teeth are located on the side of the top sideline 49, its portions on the side of its top sideline 49 are deformed earlier than its portion on the side of its bottom sideline 51.

As shown in FIGS. 9B and 10B, the first side plates 29 and the second side plates 31 are crushed locally to the positions of the top sidelines 43 of the side walls 17 of the tray 19. That is, each first side plate 29 and each second side plate 31 have a second deformation region and a third deformation region (having the length δ2 in the height direction) that project upward from level of the top sideline 43 of the associated side wall 17 and can be deformed plastically. Plastic deformation occurs in these regions.

At this time, the portions, in contact with the cap 21, of the first side plates 29 and the second side plates 31 are expanded by the plastic deformation, whereby their areas of contact to the cap 21 are increased. These contact portions are increased in compression resistance because the material density is increased there through compression. Furthermore, the top sideline 43 of the associated side wall 17 is adjacent to the contact portions of each combination of a first side plate 29 and a second side plate 31. As a result, wide seats 63 (43, 49, 57) for supporting the cap 21 are formed. Thus, a high-strength support structure capable of bearing a load W' applied from the cap 21 stably is produced.

When the load is such that the elastic deformation ranges are exceeded and the portions, having the projection length δ2 (H3−H4), of the first side plates 29 and the second side plates 31 are crushed, switching from a soft support range to a high-strength support range (described above with reference to FIG. 8) occurs in the same manner as described above. Thus, each combination of a first side plate 29 and a second side plate 31 comes to serve as a high-strength support structure.

More specifically, the above-described support mechanism consists of a soft support range which is effective until the top sidelines 49 and 57 of each combination of a first side plate 29 and a second side plate 31 are deformed to reach the position of the top sideline 43 of the associated side wall 17 and a high-strength support range which comes effective thereafter. In the soft support range, vibration or a load applied to the cap 21 can be absorbed efficiently utilizing cushioning. In the high-strength support range, even a heavy load applied to the cap 21 can be supported stably. As a result, there does not occur an event that the outer circumferential surfaces of the pancake tapes 25 (see FIG. 2) of the roll-shaped members 11 come into contact with the inner surface of the cap 21. The second side plates 31 may be deformed not only on the side of the cap 21 but also on the side of the winding cores 15.

It is preferable that the projection length δ2 (H3−H4) of the top sideline 49 of each first side plate 29 as measured from the top sideline 43 of the associated side line 17 be set in a range of 1% to 10% of the height H3. If the projection length δ2 is shorter than 1% of the height H3, the top sidelines 49 and 57 of each combination of a first side plate 29 and a second side plate 31 are deformed to reach the position of the top sideline 43 of the associated side wall 17 and the side wall 17 starts to bear a load in a low-load range. Therefore, the side wall 17 starts to be deformed in a low-load range. This increases the probability that the deformation amount of the side wall 17 goes beyond its elastic deformation range into its plastic deformation range when a heavy load is exerted on the cap 21. Plastic deformation of a side wall 17 is not preferable because it requires that an inspection as to whether the roll-shaped members 11 have been damaged or not be made after transport. On the other hand, the projection length δ2 being greater than 10% of the height H3 is not preferable because the container 100 becomes unduly large and heavy, leading to increase in transport cost and material cost. Typical dimensions are as follows: H3=400 mm, H4=380 mm, H5=250 mm, and δ2=20 mm (5% of H3).

In general, the weight of one roll-shaped member 11 is about 50 to 500 kg and a cargo in which plural roll-shaped members 11 are gathered and packed together is as heavy as about 500 to 1,000 kg. Where the winding cores 15 of roll-shaped members 11 are supported by support members made of corrugated paper, the support members are somewhat crushed by the weight of the roll-shaped members 11 themselves, possibly resulting in an event that the clearance between the outer circumferential surfaces of the roll-shaped members 11 and the bottom wall of a tray is made so small that contact occurs between them. Likewise, where plural containers are piled up, the side walls of a lower container are somewhat crushed by the weight of the containers located above it possibly resulting in an event that the clearance between the outer circumferential surfaces of the roll-shaped members 11 and the cap is made so small that contact occurs between them.

In contrast, in the above-configured container 100 according to the embodiment (particularly when the above-mentioned dimensional relationships are employed), sufficient clearances can be secured even during transport between the outer circumferential surfaces of the roll-shaped members 11 and the bottom wall of the tray 19 and between the outer circumferential surfaces of the roll-shaped members 11 and the cap 21. In a state that the slit top portions 53*a* of the winding core pressing slits 53 are in contact with the winding cores 15, gaps are formed between the bottom sidelines 55 of the second side plates 55 and the bottom wall 13 of the tray 19. Because of these gaps, the weight of the containers 100 themselves located above is exerted on the bottom wall 13 not directly but via the winding cores 15. Therefore, the roll-shaped members 11 are fixed in each of the upward and downward directions and do not float in the container 100 due to impact occurring during transport. Thus, the roll-shaped members 11 are supported stably.

As described above, in the above-configured container 100 according to the embodiment, none of various kinds of loads such as forces generated by vibration of the roll-shaped members 11, the weights of the roll-shaped members 11 themselves, and external force acting on the cap 21 do not affect the pancake tapes 25 of the roll-shaped members 11. Therefore, the roll-shaped members 11 can reliably be prevent from being damaged and can always be supported stably. In the container 100 according to the embodiment, only the portions for supporting the winding cores 15 which particularly require reinforcement against external force are reinforced, that is, the first side plates 29 and the second side plates 31 are added for reinforcement. Thus, the container 100 is inexpensive and superior in terms of size and weight reduction while the amounts of use of packing materials are reduced.

In the above-configured container 100 according to the embodiment, in the soft support range (see FIG. 8) in which the first side plates 29 and the second side plates 31 are deformed and the side walls 17 have not been deformed plastically, that part of the tray 19 which is seen from the outside of the container 100 has no changes in appearance. In the high-strength support range where the side walls 17 start to be deformed, the above part of the tray 19 changes in appearance. Therefore, whether the roll-shaped members 11 have been damaged or not can be checked easily by checking the surface states of the tray 19 before, during, or after transport. That is, it can be judged that the roll-shaped members 11 are not damaged unless plastic deformation or a deformation trace is found at least in the side walls 17 of the tray 19.

Next, a description will be made of a form of transport of the roll-shaped members 11 using above-configured containers 100.

Figure 11:
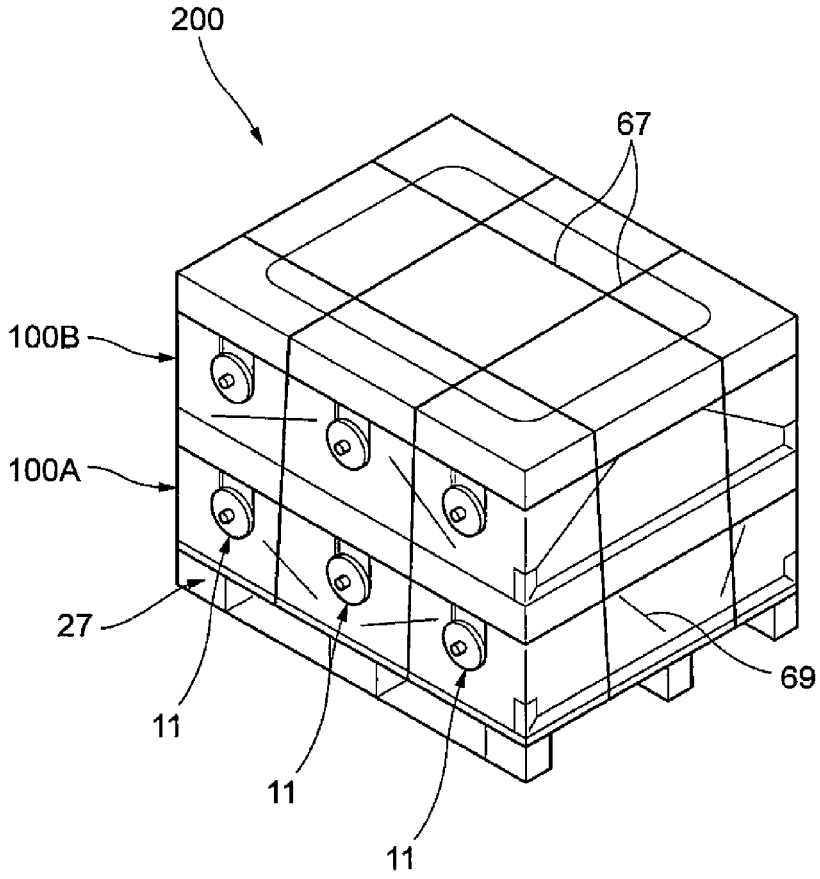
FIG. 11 is a perspective view showing an appearance of a container assembly including two piled-up containers each having the configuration according to the embodiment.

FIG. 11 is a perspective view showing an appearance of a container assembly including two piled-up containers each having the configuration according to the embodiment. Containers are transported in the form of a pallet-incorporated container assembly 200 in which a lower container 100A and an upper container 100B are piled up on a pallet 27. The employment of the pallet-incorporated container assembly 200 makes it possible to increase the efficiency of cargo-handling work for transport and storage. In the pallet-incorporated container assembly 200, the containers 100A and 100B and the pallet 27 are fastened to each other by packing bands 27 which are fixing members for preventing a load shift. And a stretch film 69 which is also a fixing member is wound on the containers 100A and 100B. The stretch film 69 is a flexible polyethylene film and not only serves for prevention of a load shift but also functions as a protective member for protecting the containers 100A and 100B from water, dust, and dirt.

Since the containers 100A and 100B are fixed by the packing bands 67 and the stretch film 69, external force can be dispersed so as to act on the containers 100A and 100B all over. Since external force is not exerted on part of the container 100A or 100B, the roll-shaped members 11 can be prevented from being damaged by the external force.

As for air transport of containers, in most airplanes, containers 100A and 100B are piled on and fixed to a transport pallet having a prescribed size. In the case of ship transport, containers 100A and 100B are transported being housed in a cargo container having a standard size. A 40-ft container, a 20-ft container, etc. are commonly used in ship transport.

Figure 12:
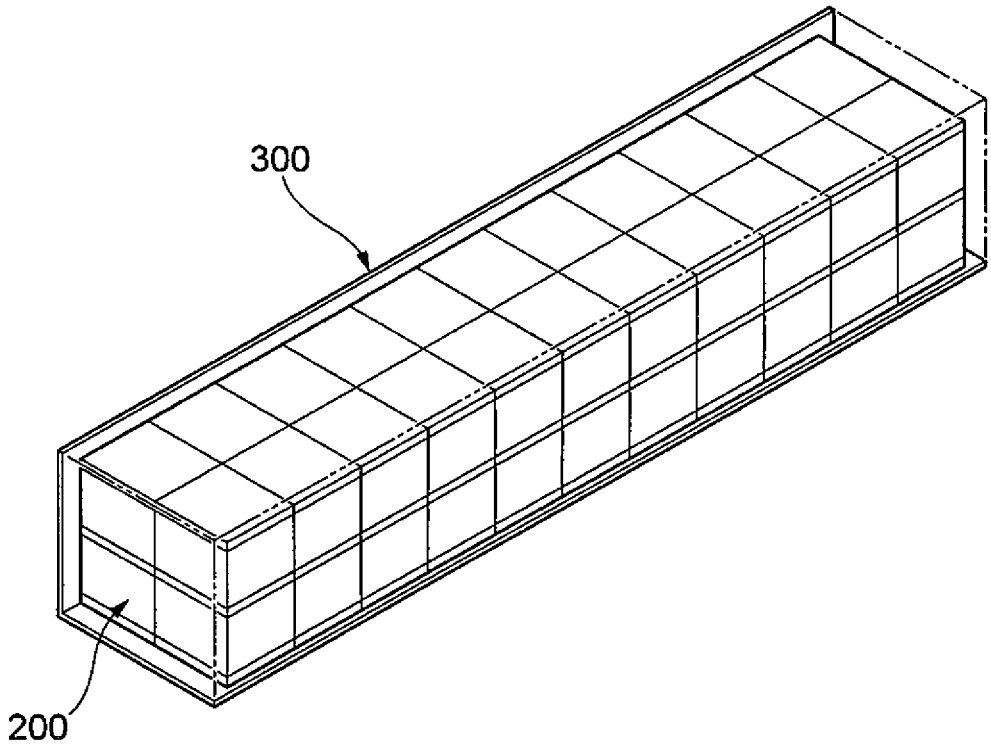
FIG. 12 is a schematic perspective view showing how containers are housed in a cargo container in ship transport.

FIG. 12 is a schematic perspective view showing how containers are housed in a cargo container in ship transport. Plural pallet-incorporated container assemblies 200 (described above) are arranged and housed in a cargo container 300. Therefore, the number of containers that can be housed in the cargo container 300 may change to a large extent even when the size of only one container is reduced slightly.

Therefore, decreasing the size of containers 100A and 100B may lead to increase in the number of containers that can be housed in one cargo container 300 or mounted on one transport pallet and hence is very effective in reducing the transport cost. The container 100 according to the embodiment can attain size and weight reduction very efficiently and lower the transport cost because the support structure for roll-shaped members is reinforced by minimum necessary amounts of packing materials.

Figure 13:
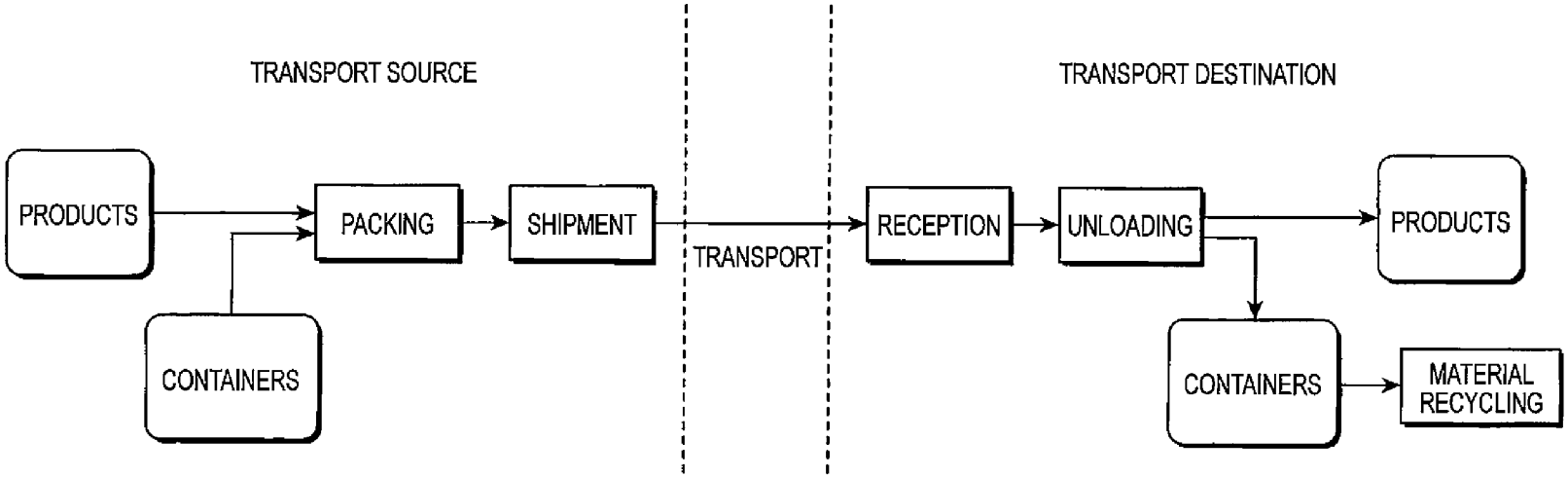
FIG. 13 is a block diagram of a transport system using containers according to the embodiment.
Figure 14:
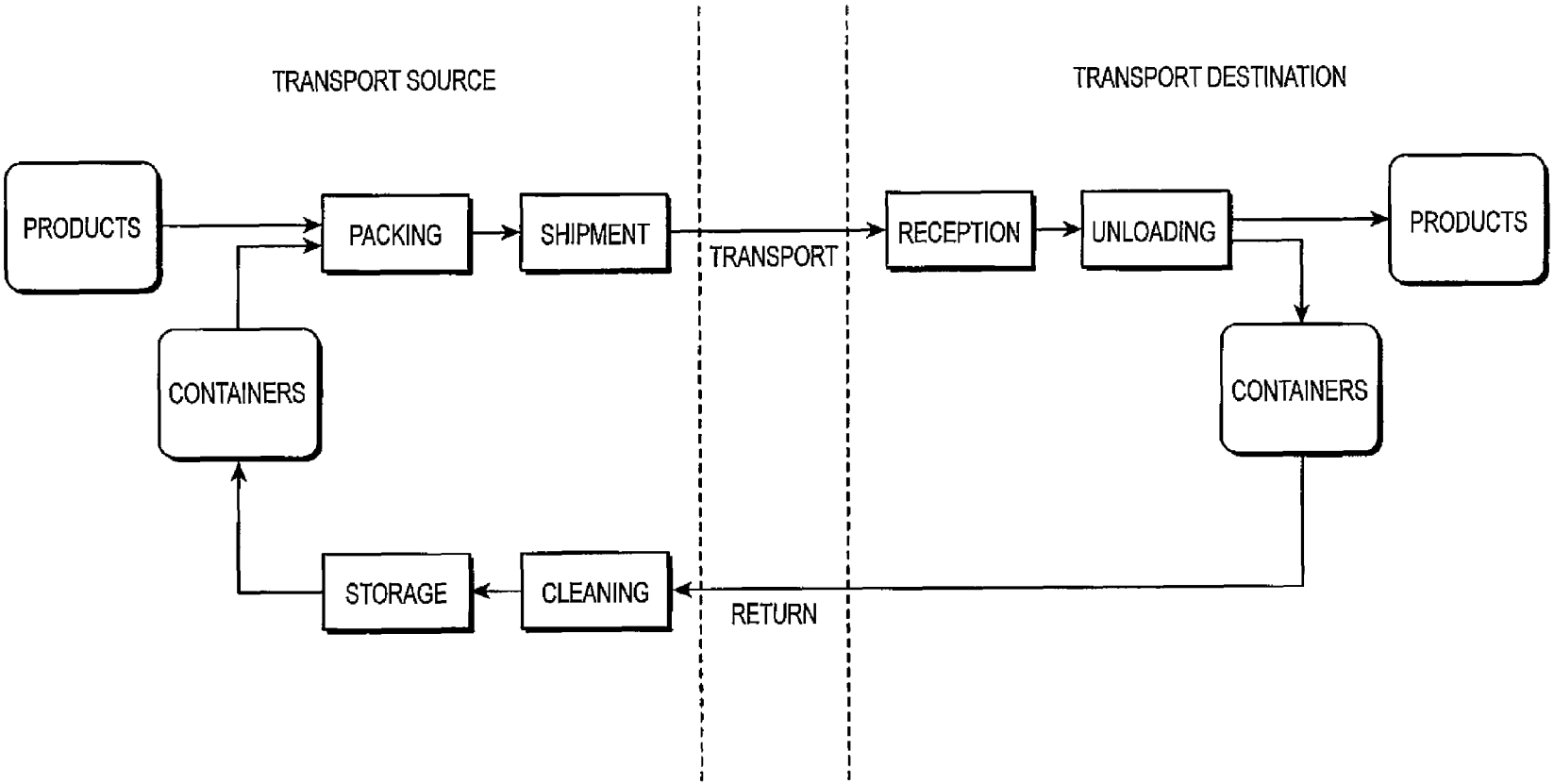
FIG. 14 is a block diagram of a transport system using conventional containers.

FIG. 13 is a block diagram of a transport system which uses containers 100 according to the embodiment in a disposable manner. Roll-shaped members 11 as products are packed using containers 100 and shipped from a transport source. At a transport destination, the container assemblies are received and unpacked and the products are unloaded and separated from the containers 100. Since almost all of each container 100 is made of corrugated paper, at the transport destination the containers 100 are put into a material recycling process.

In the above transport system, although containers 100 that have been used for transport are disposed of without being used again, their material (corrugated paper) is submitted to recycling. Therefore, part of the material cost can be recovered. Furthermore, neither a process of returning used containers 100 to a transport source nor a process of cleaning used containers 100 is necessary, whereby the total transport cost can be reduced.

The invention is not limited to the above embodiment. The invention expects that those skilled in the art would make modifications and applications on the basis of the disclosure of the specification and known techniques. The scope of protection should encompass such modifications and applications. For example, although in the embodiment the container 100 is made of corrugated paper, any of materials that are equivalent to corrugated paper in terms of properties and price can be used for a container according to the invention. The roll-shaped member is not limited to one in which magnetic recording tapes are wound on a winding core, and may be in any of various forms like one in which another kind of band-shaped material is wound on a core, one in which a cylindrical member is attached to a core, and one in which a core itself has a wide-diameter portion that is in roll form. Although in the embodiment the first, second, and third slits are formed in the vertical direction, they may be formed in directions in which external forces are exerted.

As described above, the following items are disclosed in the specification:

(1) A container for housing a roll-shaped member having a core, comprising;

a tray having a bottom wall and a pair of side walls which are erected from the bottom wall so as to be opposed to each other and to extend perpendicularly to an axis of the core when the roll-shaped member is housed in the container;

a pair of first side plates disposed on the bottom wall parallel with the respective side walls; and a cap which has a top wall opposed to the bottom wall of the tray and is disposed so that the roll-shaped member can be interposed between the cap and the tray, wherein:

each of the pair of side walls is formed with a first slit which extends from a top sideline of the side wall to a halfway position in a direction toward a bottom sideline of the side wall, and in which the core of the roll-shaped member can be inserted;

each of the pair of first side plates is formed with a second slit which extends from a top sideline of the first side plate to a halfway position in a direction toward a bottom sideline of the first side plate, which is located at such a position as to face the associated first slit with the first side plate disposed on the bottom wall of the tray parallel with the associated side wall, and which is to support the core; and a height H1 of a slit bottom portion of the first slit of each of the side walls and a height H2 of a slit bottom portion of the second slit of each of the first side plates as measured from the bottom wall of the tray with the pair of first side plates disposed on the bottom wall parallel with the respective side walls satisfy a relationship H2>H1.

(2) The container according to item (1), wherein a height H3 of the top sideline of each of the first side plates and a height H4 of the top sideline of each of the side walls as measured from the bottom wall of the tray with the pair of first side plates disposed on the bottom wall parallel with the respective side walls satisfy a relationship H3>H4.

(3) The container according to item (1) or (2), wherein each of the pair of side walls and each of the pair of first side plates are formed with plural first slits and plural second slits, respectively, at such positions that the second slits face the respective associated first slits, and cores of plural roll-shaped members are to be inserted in and supported by respective combinations of a first slit and a second slit.

(4) The container according to any one of items (1) to (3), further comprising a pair of second side plates which are disposed parallel with the side walls and the first side plates, respectively, whose top sidelines project upward from the levels of the top sidelines of the side walls, respectively, and are in contact with the top wall of the cap, and each of which is formed with a third slit which extends from a bottom sideline of the second side plate to a halfway position in a direction toward the top sideline of the second side plate, which is located at such a position as to face the associated first slit, and whose slit top portion comes into contact with the core when the roll-shaped member is housed in the container.

(5) The container according to item (4), wherein each of the tray, the first side plates, the second side plates, and the cap is made of a corrugated paper material.

(6) The container according to item (5), wherein the corrugated paper material has a multilayer structure having plural liner layers and core layers.

(7) The container according to any one of items (4) to (6), wherein each of the first slits, the second slits, and the third slits is a U-shaped slit.

(8) The container according to any one of items (1) to (7), wherein:

the bottom wall of the tray and the top wall of the cap each have first engagement portions in such a manner that each associated pair of first engagement portions are located at positions corresponding to each other and have a male portion and a female portion capable of engaging with each other.

(9) The container according to any one of items (1) to (8), wherein the roll-shaped member is a roll-shaped member in which magnetic recording tapes are wound on the core.

(10) A pallet-incorporated container assembly comprising:

the container according to any one of items (1) to (9); and a pallet which is mounted with the container on a top surface.

(11) The pallet-incorporated container assembly according to item (10), wherein the bottom wall of the tray and the top surface of the pallet each have second engagement portions in such a manner that each associated pair of second engagement portions are located at positions corresponding to each other and have a male portion and a female portion capable of engaging with each other.

(12) The pallet-incorporated container assembly according to item (11), wherein each of the first engagement portions of the cap has the same shape as each of the second engagement portions of the pallet.

(13) The pallet-incorporated container assembly according to any one of items (10) to (12), further comprising a fixing member for fixing the container to the pallet.

(14) The pallet-incorporated container assembly according to item (13), wherein the fixing member includes at least one of a packing band and a stretch film.

What is claimed is:

1. A container for housing a roll-shaped member having a core, comprising:

a tray having a bottom wall and a pair of side walls which are erected from the bottom wall so as to be opposed to each other and to extend perpendicularly to an axis of the core when the roll-shaped member is housed in the container;

a pair of first side plates disposed on the bottom wall parallel with the respective side walls; and a cap which has a top wall opposed to the bottom wall of the tray and is disposed so that the roll-shaped member can be interposed between the cap and the tray, wherein:

each of the pair of side walls is formed with a first slit which extends from a top sideline of the side wall to a halfway position in a direction toward a bottom sideline of the side wall, and in which the core of the roll-shaped member can be inserted;

each of the pair of first side plates is formed with a second slit which extends from a top sideline of the first side plate to a halfway position in a direction toward a bottom sideline of the first side plate, which is located at such a position as to face the associated first slit with the first side plate disposed on the bottom wall of the tray parallel with the associated side wall, and which is to support the core; and a height H1 of a slit bottom portion of the first slit of each of the side walls and a height H2 of a slit bottom portion of the second slit of each of the first side plates as measured from the bottom wall of the tray with the pair of first side plates disposed on the bottom wall parallel with the respective side walls satisfy a relationship H2>H1.

2. The container according to claim 1, wherein a height H3 of the top sideline of each of the first side plates and a height H4 of the top sideline of each of the side walls as measured from the bottom wall of the tray with the pair of first side plates disposed on the bottom wall parallel with the respective side walls satisfy a relationship H3>H4.

3. The container according to claim 1, wherein each of the pair of side walls and each of the pair of first side plates are formed with plural first slits and plural second slits, respectively, at such positions that the second slits face the respective associated first slits, and cores of plural roll-shaped members are to be inserted in and supported by respective combinations of a first slit and a second slit.

4. The container according to claim 1, further comprising a pair of second side plates which are disposed parallel with the side walls and the first side plates, respectively, whose top sidelines project upward from the levels of the top sidelines of the side walls, respectively, and are in contact with the top wall of the cap, and each of which is formed with a third slit which extends from a bottom sideline of the second side plate to a halfway position in a direction toward the top sideline of the second side plate, which is located at such a position as to face the associated first slit, and whose slit top portion comes into contact with the core when the roll-shaped member is housed in the container.

5. The container according to claim 4, wherein each of the tray, the first side plates, the second side plates, and the cap is made of a corrugated paper material.

6. The container according to claim 5, wherein the corrugated paper material has a multilayer structure having plural liner layers and core layers.

7. The container according to claim 4, wherein each of the first slits, the second slits, and the third slits is a U-shaped slit.

8. The container according to claim 1, wherein:

the bottom wall of the tray and the top wall of the cap each have first engagement portions in such a manner that each associated pair of first engagement portions are located at positions corresponding to each other and have a male portion and a female portion capable of engaging with each other.

9. The container according to claim 1, wherein the roll-shaped member is a roll-shaped member in which magnetic recording tapes are wound on the core.

10. A pallet-incorporated container assembly comprising:

the container according to claim 1; and a pallet which is mounted with the container on a top surface.

11. The pallet-incorporated container assembly according to claim 10, further comprising a fixing member for fixing the container to the pallet.

12. The pallet-incorporated container assembly according to claim 11, wherein the fixing member includes at least one of a packing band and a stretch film.

13. A pallet-incorporated container assembly comprising:

the container according to claim 8; and a pallet which is mounted with the container on a top surface, wherein the bottom wall of the tray and the top surface of the pallet each have second engagement portions in such a manner that each associated pair of second engagement portions are located at positions corresponding to each other and have a male portion and a female portion capable of engaging with each other.

14. The pallet-incorporated container assembly according to claim 13, wherein each of the first engagement portions of the cap has the same shape as each of the second engagement portions of the pallet.

* * * * *